United States Patent [19]

Tragesser et al.

[11] 4,090,052

[45] May 16, 1978

[54] TANK-TYPE OIL CIRCUIT-INTERRUPTER WITH JET FORCES COUNTERBALANCING THE MAGNETIC FORCES

[75] Inventors: Charles W. Tragesser, Murrysville; Ronald E. Vaill, Penn Township, Westmoreland County; Richard J. Bohinc, Hempfield Township, Westmoreland County; Francis R. Racki, O'Hara Township, Allegheny County, all of Pa.

[73] Assignee: Westinghouse Electric Corp., Pittsburgh, Pa.

[21] Appl. No.: 680,630

[22] Filed: Apr. 27, 1976

[51] Int. Cl.[2] ..... H01H 33/68

[52] U.S. Cl. ..... 200/150 R; 200/150 E

[58] Field of Search ..... 200/150 E, 150 R, 150 D

[56] References Cited

U.S. PATENT DOCUMENTS

| | | | |
|---|---|---|---|
| 2,092,656 | 9/1937 | Prince et al. | 200/150 E |
| 2,467,542 | 4/1949 | Taylor | 200/150 E |
| 2,467,760 | 4/1949 | Ludwig et al. | 200/150 R |
| 2,749,411 | 6/1956 | Kelle | 200/150 R |
| 3,900,946 | 8/1975 | Jawelak | 200/150 R |

*Primary Examiner*—Robert S. Macon
*Attorney, Agent, or Firm*—W. R. Crout

[57] ABSTRACT

A tank-type oil circuit-breaker has a pair of arc-extinguishing grid-structures disposed interiorly within the oil tank, each of said arc-extinguishing grid-structures having a pair of outwardly-directed horizontally-laterally-spaced venting ports, with the angular direction, or divergence between the two horizontally-spaced venting ports of somewhat critical angular magnitude.

The construction is such that the two spaced venting ports on each arc-extinguishing grid structure collectively produce a resultant inwardly-directed jet force, which substantially counterbalances the outwardly-directed magnetic and mechanical forces resulting from the U-shaped line-current flow passing through the circuit-interrupter.

The angular separation, or angular divergence provided between the two horizontally-laterally-spaced venting ports of each arc-extinguishing grid-structure falls within the range of angular magnitude of 80° to 160°. A desirable divergence range is between 100° and 140°, and preferably, the angular divergence is desirably 120 angular degrees.

14 Claims, 24 Drawing Figures

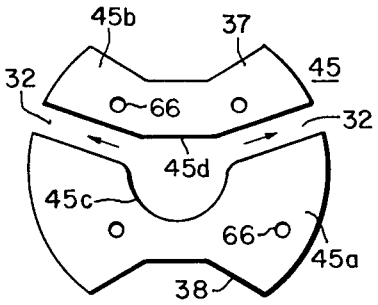
FIG. 13
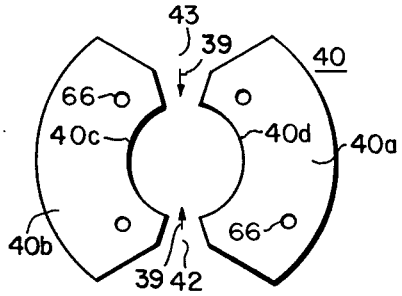
FIG. 14
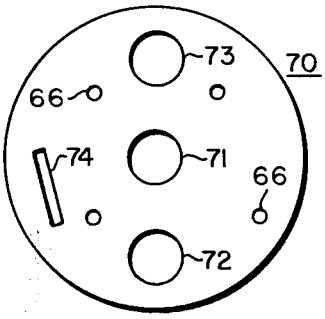
FIG. 15
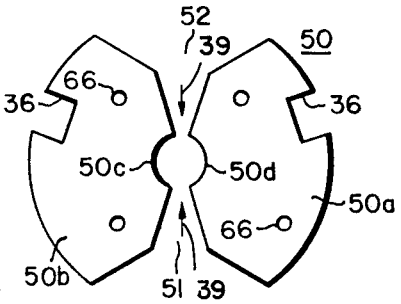
FIG. 16
FIG. 17
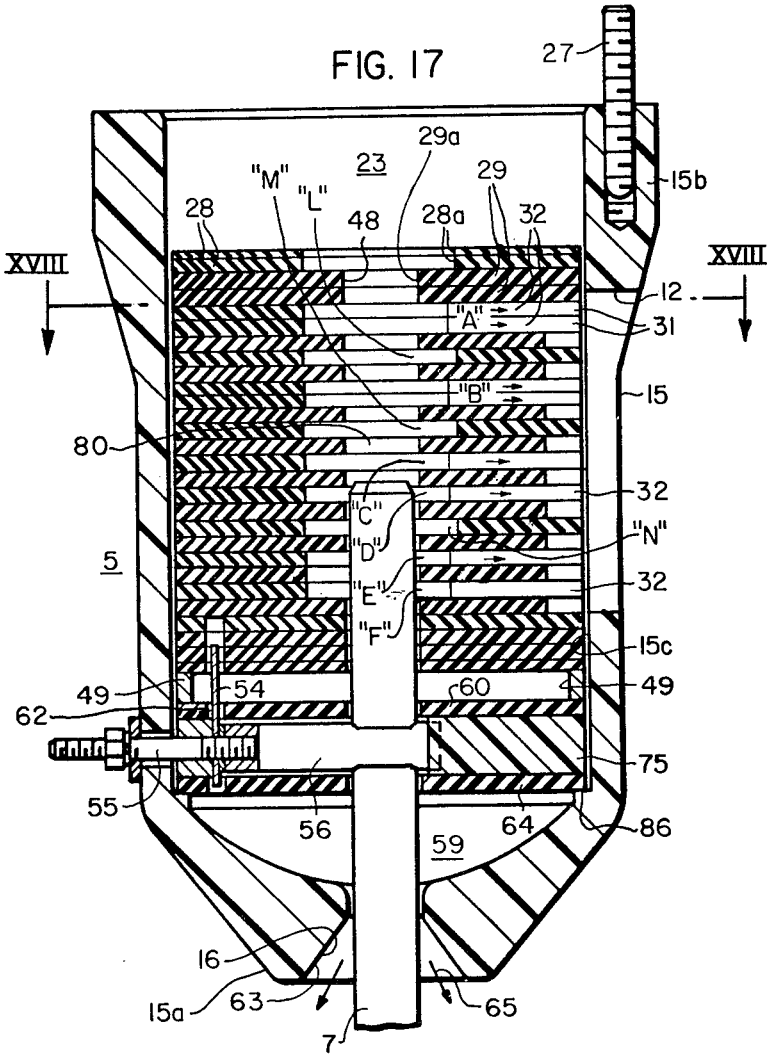
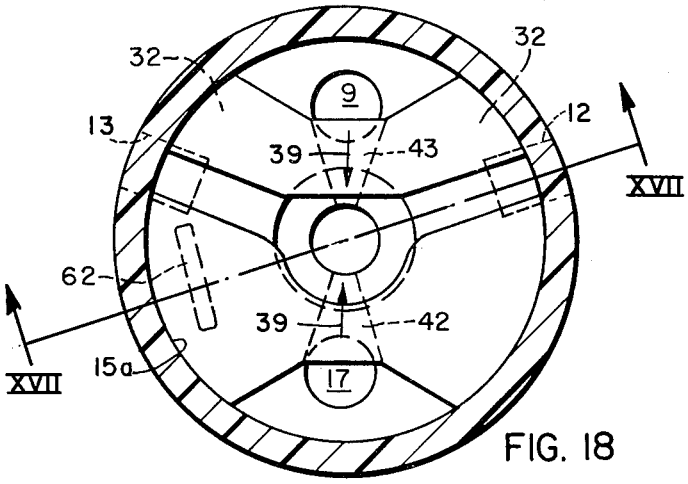
FIG. 18

TANK-TYPE OIL CIRCUIT-INTERRUPTER WITH JET FORCES COUNTERBALANCING THE MAGNETIC FORCES

CROSS-REFERENCE TO RELATED APPLICATIONS

Reference is made to Unites States patent application filed Apr. 27, 1976, Ser. No. 680,631, by Charles W. Tragesser and R. E. Vaill, and to United States patent application filed July 31, 1975, Ser. No. 600,556, by Richard J. Bohinc et al, said two patent applications being assigned to the assignee of the instant application.

BACKGROUND OF THE INVENTION

As is well known by those skilled in the art, in providing oil-type circuit-interrupters, it has been common practice to provide interrupter extinguishing grid structures formed by contiguously stacking a plurality of suitably-configured insulating plate elements. As typical of such prior-art structures, reference may be made to U.S. Pat. No. 3,646,296, issued Feb. 29, 1972 to Robert L. Hess and Gerald D. Simmers, and assigned to the assignee of the instant patent application. Such an oil-grid structure provides oil pockets and side lateral venting passages, all having the function of creating turbulence and providing an exhausting lateral venting action to assist in extinguishing the drawn arc, which is established and lengthened within the extinguishing grid structure by the downward opening separating movement of a rod-shaped movable contact away from an upper-disposed stationary finger-type contact structure.

As descriptive of additional prior-art constructions, reference may also be made to U.S. Pat. No. 3,356,811, issued Dec. 5, 1967 to George B. Cushing and Frank L. Reese, and also assigned to the assignee of the present invention. With regard to oil-pumping assemblies, reference may additionally be made to Jawelak et al U.S. Pat. No. 3,819,893, issued July 26, 1972, and Jawelak et al U.S. Pat. No. 3,867,597, issued Feb. 18, 1975.

It is well known in the art to provide oil-grid structures having pairs of lateral venting passages. Consider, for example, U.S. Pat. No. 2,811,614, issued Oct. 29, 1957 to P. L. Taylor et al, in which FIG. 9 of said patent shows lateral venting ports 64 and 65. In addition, reference may be made to U.S. Pat. Nos. 2,545,334 and 2,539,175, both issued to Conrad J. Balentine and showing venting passages 41 in FIG. 3 of Balentine U.S. Pat. No. 2,545,334, and venting passages **44*a* in FIG. 4** of Balentine U.S. Pat. No. 2,539,175.

Of interest also, in regard to laminated plate structures, encompassed within an outer-disposed insulating cup-shaped casing, for maintaining the plates in a proper position, reference may be had to U.S. Pat. No. 3,819,893, issued June 25, 1974 to Melbourne G. Jawelak et al. In addition, this latter patent, Jawelak et al U.S. Pat. No. 3,819,893 shows an oil-pumping assembly 32, 32' disposed on the inner sides of the grid units 14, 16, as illustrated in FIG. 1 of said patent.

SUMMARY OF THE INVENTION

According to a preferred embodiment of the present invention, there is provided an improved tank-type oil circuit-breaker, including a pair of arc-extinguishing grid-structures disposed interiorly within the oil-tank, and each arc-extinguishing structure having a pair of horizontally-laterally-spaced venting ports. Preferably, the direction or, more properly, the angular divergence of the two venting ports of each arc-extinguishing grid structure is somewhat critical, in the effort made to have their combined outward jet forces substantially counterbalance the outwardly-directed magnetic mechanical forces resulting from the U-shaped line-current path extending through the oil circuit-breaker.

As well known by those skilled in the art, the general line-current path through the oil-type, tank circuit-breaker is downwardly through one terminal-bushing, through the separable contact structure within one grid-unit, downwardly through the rod-shaped movable contact, horizontally through the conducting bridging member, and in a similar fashion, upwardly through the other companion arc-extinguishing grid structure, through the respective separable contact structure of said other arc-extinguishing grid structure, and upwardly and angularly outwardly of the tank structure through the other terminal-bushing of the device.

As a result, the line-current flow passing through the said circuit-interrupter traverses a substantially U-shaped current path. Also, as well known by those skilled in the art, the magnetic field encompassing the said line-current path provides magnetic opposing interaction forces between the conducting component structures, somewhat parallel in arrangement, and the line-currents therein passing in substantially opposite directions. The magnetic lines of force are, consequently, crowded within the lower bight portion of the current path and tend to mechanically force the terminal-bushing structures mechanically outwardly in an effort to "straighten" the line-current path. This outward magnetic force, of course, only approaches a theoretical zero value when the line-current path is physically in a straight line.

We have discovered that the angular divergence between the two laterally-spaced venting ports of each arc-extinguishing structure should, preferably, be between 80°, but less than 160°. A desirable divergence range is between 100° and 140° and of preferable selection, however, is the optimum angular divergence of 120 angular degrees.

BRIEF DESCRIPTION OF THE DRAWINGS

FIGS. 9–16 are plan views of plate details used in assembling the grid structure drawn to a somewhat smaller scale.

FIG. 17 is a vertical sectional view taken substantially along the line XVII—XVII of FIG. 18;

FIG. 18 is a plan view, in section, taken substantially along the line XVIII—XVIII of FIG. 17 looking in the direction of the arrows;

DESCRIPTION OF THE PREFERRED EMBODIMENT

Figure 1:
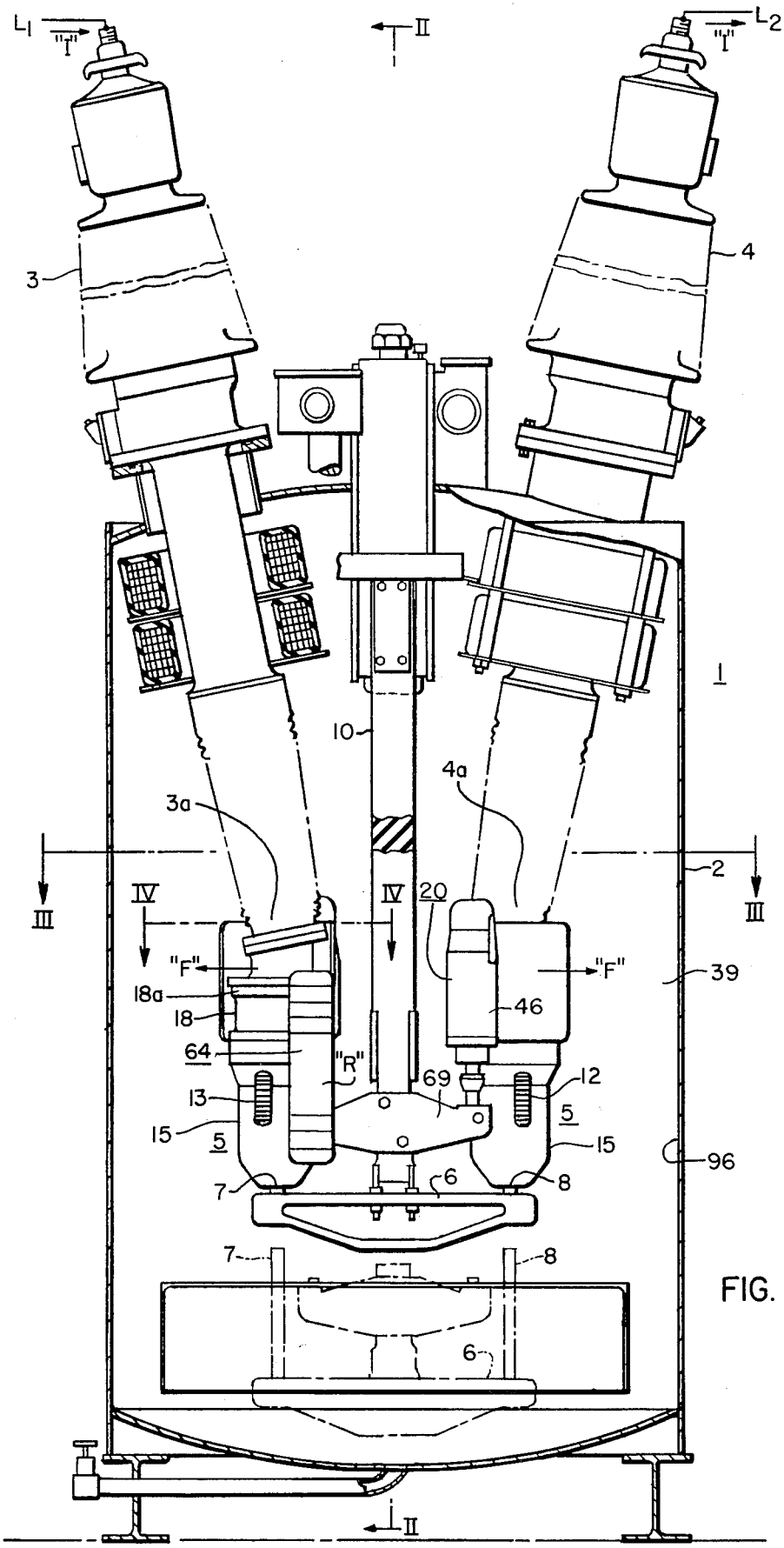
FIG. 1 is a vertical-sectional view of an oil circuit-breaker incorporating the principles of the present invention, with the separable contact structure being illustrated in the closed-circuit position.

Referring to the drawings, and more particularly to FIG. 1 thereof, the reference numeral 1 generally designates an oil-type circuit-interrupter illustrating a tank 2, within which extends a pair of terminal-bushings 3 and 4 having appended thereto, at the lower ends 3*a*, 4*a*, thereof, interrupter extinguishing grid-units, designated by the reference numeral 5, and electrically interconnected by a conducting cross-bar 6 having upstanding rod-shaped movable contacts 7, 8 secured thereto adjacent the outer ends thereof.

An insulating reciprocally-operable operating-rod, or lift-rod 10 is vertically reciprocally actuated by a suitable operating mechanism, not shown, and thus effects the simultaneous opening and closing movements of the two rod-shaped movable contact rods 7, 8.

Figure 5:
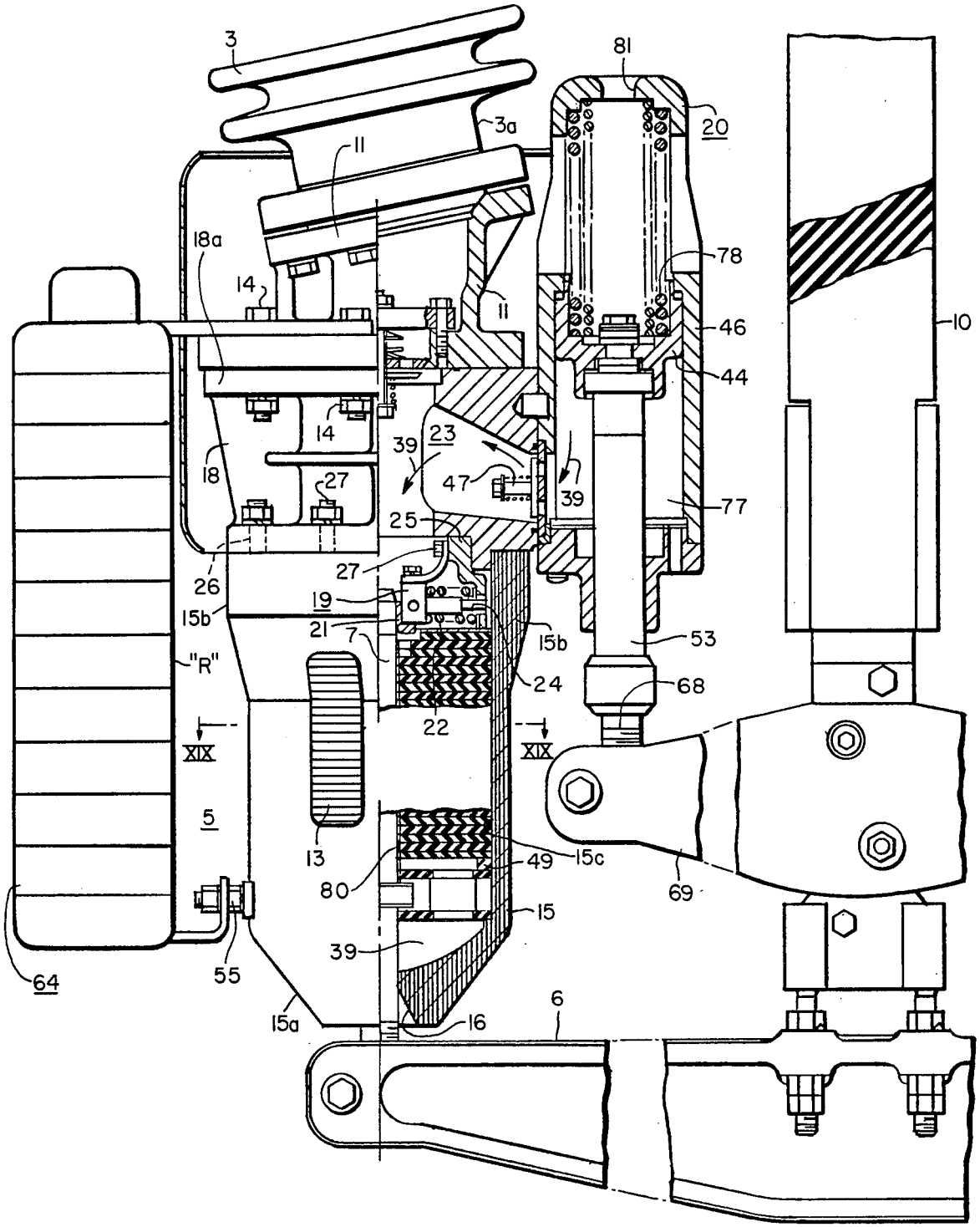
FIG. 5 is a considerably-enlarged vertical-sectional view taken substantially along the broken-sectional line V—V of FIG. 4 looking in the direction of the arrows, with the separable contact structure being illustrated in the closed-circuit position and the resistor assemblage displaced in position.
Figure 6:
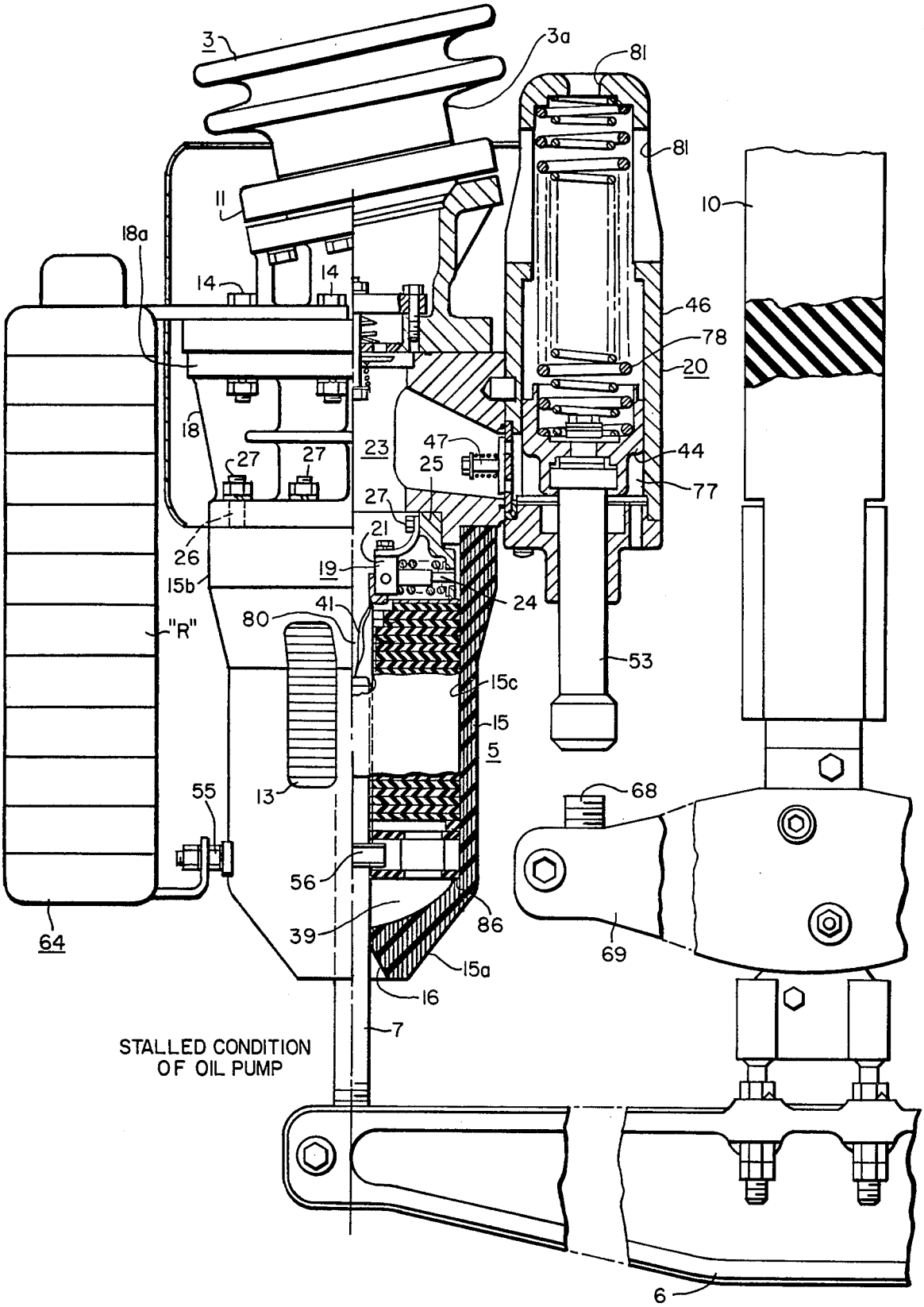
FIG. 6 is a view similar to that of FIG. 5 but showing the arcing conditions, the view being taken along the line V—V of FIG. 4.

FIGS. 5 and 6 illustrate only the lefthand interrupting grid structure 5 of FIG. 1, the other one on the right of the view, as shown in FIG. 1, merely being a duplicate thereof, with the exception that the vent openings 12, 13 of the righthand unit 5 are facing in the opposite directions. As additionally shown in FIG. 5, it will be observed that there is provided an upper casting member, or contact housing 18 enclosing a stationary contact structure 19, in this instance comprising two finger contacts 21, each of which is based inwardly by a suitable compression spring 22. In more detail, each of the finger contacts 21 has a stud-bolt 24 attached to the finger structure 21, and passing through an opening in a bracket, designated by the reference numeral 25, and affixed by a bolt 27 to the hollow casting housing member 18.

The arc-extinguishing grid structure 5 is formed by contiguously stacking and cementing together a plurality of insulating plate elements made of any suitable insulating material, such as fiber, for example. The stacked, cemented assembly 5 is then positioned and supported within a surrounding insulating hollow shell-member 15 made, for example, of "Delrin", or any suitably-strong insulating material. As shown in FIG. 5, the insulating shell-member 15 has an inward-tapered lower skirt portion 15*a* having a beveled central opening 16 provided therein to accommodate the vertical movements of the movable contact-rod 7 or 8 as the case may be.

Figure 20:
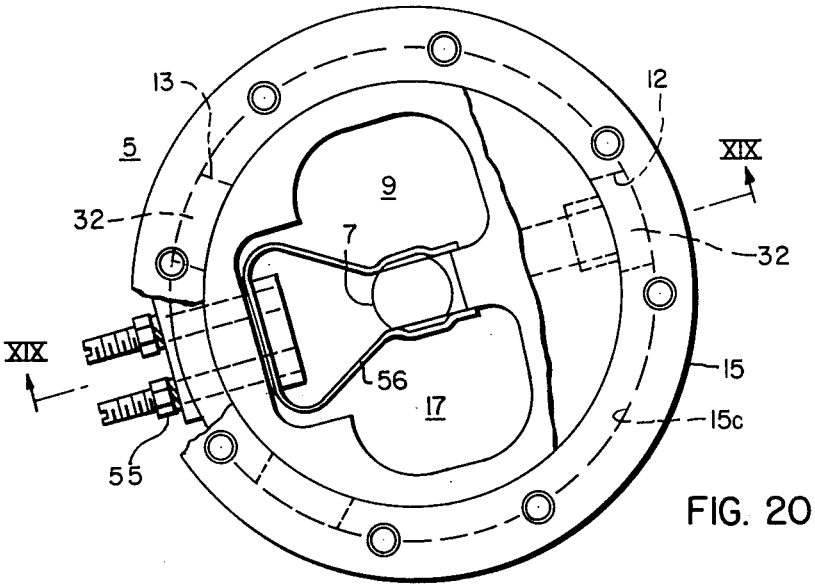
FIG. 20 is a broken sectional plan view taken substantially along the line XX—XX of FIG. 19; and, FIGS. 21–24 are diagrammatic views illustrating the principles of our invention.

With reference being particularly directed to FIGS. 1, 18 and 20, it will be observed that there is provided through the sidewalls of the insulating shell-member 15 a pair of laterally-spaced vent openings 12, 13 facing in somewhat opposite angular directions from each other. The particular angular positioning, or divergence between these vent openings 12, 13, provided in the shell-member 15, is important, as set forth more fully hereinafter.

It will be observed that an upper oil-pumping assembly 20 is provided, which forces a flow of oil under pressure downwardly into the upper storage chamber 23 provided within the upper metallic casting foot 18, which supports the grid structure 5 from the lower end 3*a* of the terminal-bushing 3. The metallic casting member 18 has a plurality of suitably-provided mounting holes 26 (FIG. 5) provided therein, which accommodate mounting bolts 27, which fixedly secure in place the upper enlarged peripheral edge 15*b* of the outer insulating shell 15, as more clearly shown in FIG. 19. Additionally, the upper portion 18*a* of the casting foot 18 has a flange portion integrally provided therewith, through which extend a plurality of mounting bolts 14 securing a metallic adaptor 11 to the lower end 3*a* of the terminal bushing 3. Also, it will be noted that the upper metallic casting member 18 provides a rigid securement for the oil-pumping assembly 20 itself.

With particular reference being directed to FIGS. 7, 8, 9 and 18, it will be observed that the upper two insulating plates 28 (FIG. 9) of the grid stack 5 have enlarged central openings 28*a* provided therein. These openings 28*a* accommodate the two cooperable stationary contact fingers 21, which collectively form the relatively-stationary main contact structure 19.

Figure 10:
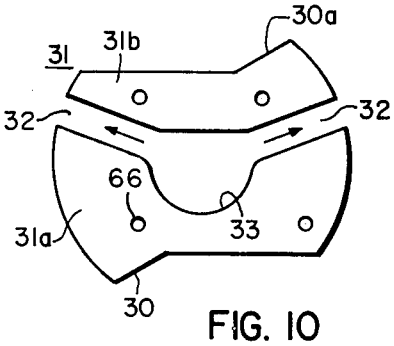

Immediately below the upper two insulating plates 28 is a pair of similarly-shaped, but somewhat thicker, insulating plates 29 having a somewhat smaller central opening 29*a* provided therein. Again, reference may be made to FIG. 9 of the drawings, which illustrates the configuration of the plates 28 and 29 more clearly. The next two lower successive insulating plates are called herein "venting" plates 31, and comprise a pair of laterally-spaced, or horizontally-spaced plate portions 31*a* and 31*b* spaced laterally apart, as shown more clearly in FIG. 10, providing therebetween a pair of horizontal venting passages 32 (FIG. 7) leading in divergent angular directions from the grid structure 5. The particular angular disposition and divergence arrangement of these two laterally spaced horizontal venting passages 32 is somewhat critical to thereby counteract the high magnetic forces "F" (FIG. 1) resulting from the considerable current flow "I" passing through the circuit-interrupter unit 1, and thereby imposing undesirable lateral mechanical forces upon the lower ends 3*a*, 4*a* of the downwardly-extending terminal bushings 3, 4.

In order to provide an adequate flow of extinguishing oil from the pumping assembly 20 through the upper oil reservoir chamber 23, and into the arc 41, established within the grid-plate structure 5, there is, for example, provided two vertically-extending liquid-flow passages 9, 17 leading vertically downwardly along the inner sides 15*a* of the outer insulating shell-like member 15, as more clearly illustrated in FIGS. 18 and 20. These two somewhat diametrically-disposed liquid-flow oil-pumping passages 9, 17 are provided by the alignment of cutout portions 30, 38 removed from the sides of the several insulating plate elements 28, 29, 34, 45 and 60, as illustrated more clearly in FIGS. 9–16 of the drawings.

As a result, liquid flow, such as an oil flow 39, is generated by downward movement of the movable piston 44 within the operating cylinder 46, through the valve structure 47, through the upper oil chamber 23, down through the laterally-spaced vertical liquid-flow passages 9 and 17, and generally horizontally inwardly through inlet plates 40 and 50 (FIGS. 14 and 16) at different levels within the grid structure 5. Continuing the insulating-plate description, as set forth above, it will be observed with reference to FIG. 8, that disposed between two orifice plates 34, as individually illustrated more clearly in FIG. 11 of the drawings, there is provided an intervening inlet-plate 40, as shown more clearly in FIG. 14, comprising two laterally-spaced half-inlet plate-portions 40*a* and 40*b*, as shown separated in FIG. 14. The lateral spacing between the two half-plate portions 40*a* and 40*b* gives rise to inlet passages 42, 43, as more clearly illustrated by the dotted lines in FIGS. 7 and 18 of the drawings.

Figure 7:
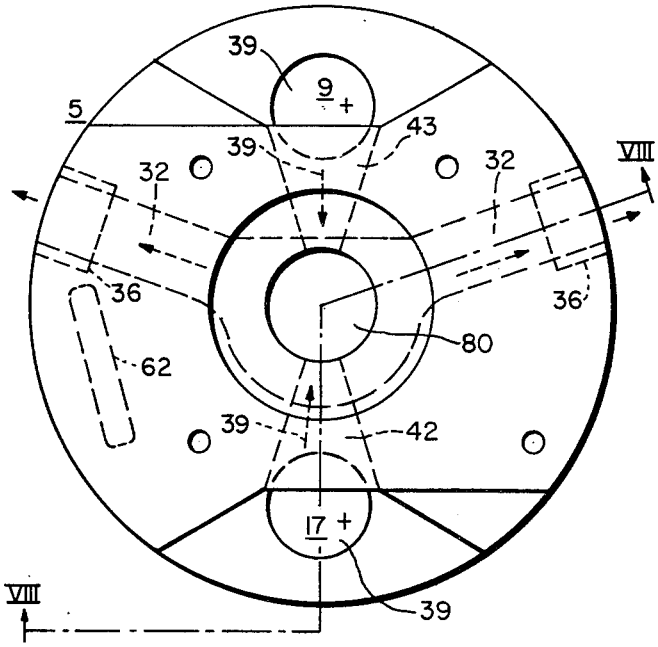
FIG. 7 is a plan view, in section, taken substantially along the line VII—VII of FIG. 8.
Figure 9:
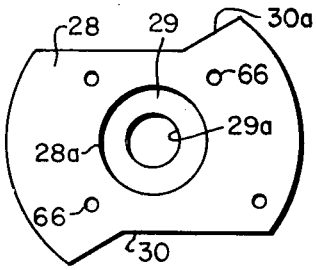
Figure 8:
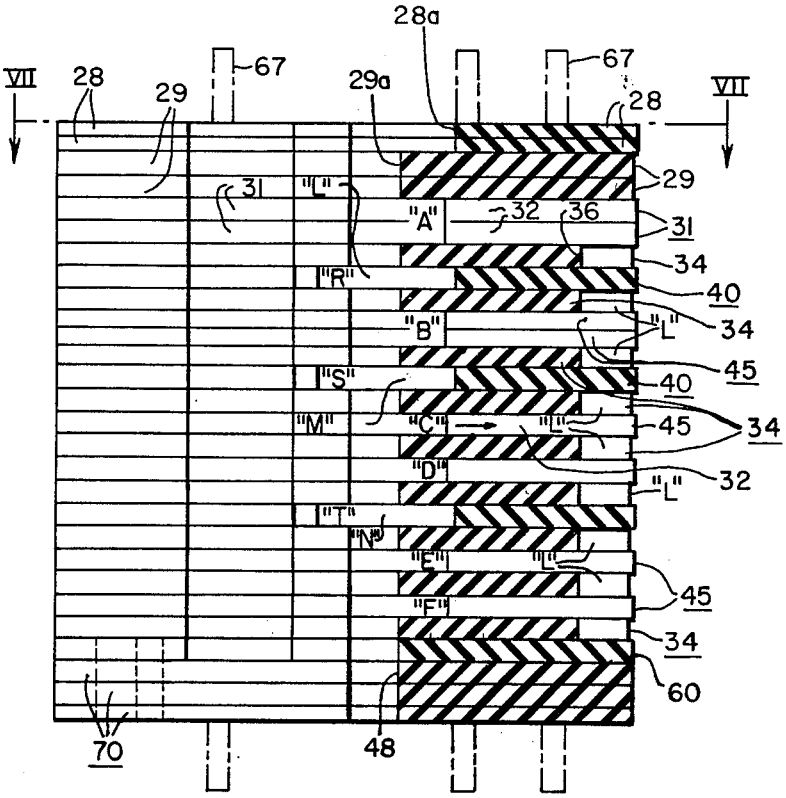
FIG. 8 is a vertical, partial sectional view taken substantially along the line VIII—VIII of FIG. 7.

As mentioned, above and below the inlet-plate 40 as shown in FIG. 8 are positioned the so-called "orifice" plates 34, more clearly illustrated individually in FIG. 11. Then follows two venting plates 45, as shown in FIG. 8, each of which has the configuration set forth in FIG. 13 of the drawings. With reference being directed to FIG. 13, it will be observed that again there are provided cutout portions 37, 38 assisting in the alignment, with the other cutout portions 30, 30*a*, 37, 38, to form the aforesaid laterally-spaced vertical-flow liqud oil passages 9, 17 (FIGS. 7 and 18) leading from the pump assembly 20 to the inlet-plate levels "R", "S" and "T" (FIG. 8), where the oil 39, under pressure, is forced horizontally inwardly toward the established arc 41 (FIG. 6) to effect its rapid extinction.

Figure 11:
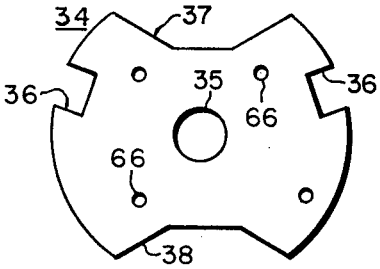

Then follows an orifice plate 34, another inlet plate 40 (FIG. 14) and a second orifice plate, as again shown more clearly in FIG. 11 of the drawings.

It will be noted that the orifice plates 34, as shown in FIG. 11, have notches 36 provided therein at the side edges thereof to align with the venting-flow passages 32, so as to provide an enlarged portion "L" (FIG. 8) at the peripheral outer end of each venting passage 32. This enlarged venting structure 32 is more clearly illustrated in FIGS. 7, 8 and 18 of the drawings.

Then follows a vent plate, an orifice plate, another vent plate, an orifice plate, another inlet plate, another orifice plate, another venting plate, an orifice plate, and a final venting plate and another orifice plate. Then follows a plurality of orifice plates 60, roughly four in number, for example, providing a relatively-restricted orifice opening 48 disposed adjacent the lower end 15*a* of the grid stack 5, as more clearly illustrated in FIGS. 8, 17 and 19 of the drawings.

As illustrated more clearly in FIGS. 17 and 19 adjacent the lower end of the grid stack 5 is a compression ring 49, made of a suitable resilient material, such as neoprene, for example, below which is an insulating plate 60, one-fourth inch thick, for example, and having a configuration more clearly shown in FIG. 12 of the drawings.

It will be observed that the plate 60 has a rectangularly-shaped slot 62 provided therein, which serves a keying function to accommodate a metallic locking plate 54 (FIGS. 19 and 20), which is affixed to a laterally-extending stationary resistance contact terminal 55 extending externally of the grid stack 5, and electrically connected to a vertically-extending shunting resistor assembly 64. The function of the resistor assembly 64, which may have an ohmic value of 700 ohms, for example, is to assist in interrupting the arc 41 (FIG. 6) established interiorly of the grid stack 5. At a subsequent point in time, the movable contact 7 separates from the stationary resistance contact 56, the latter comprising a U-shaped metallic spring-contact configuration, as shown more clearly in FIGS. 19 and 20 of the drawings. Thus, the movable contact rod 7 makes sliding contacting engagement with the lower-disposed stationary resistance contact 56, maintaining electrical contact therewith, and ultimately separating therefrom to establish a residual-current arc 57, as diagrammatically illustrated more clearly in FIG. 19 of the drawings.

Figure 19:
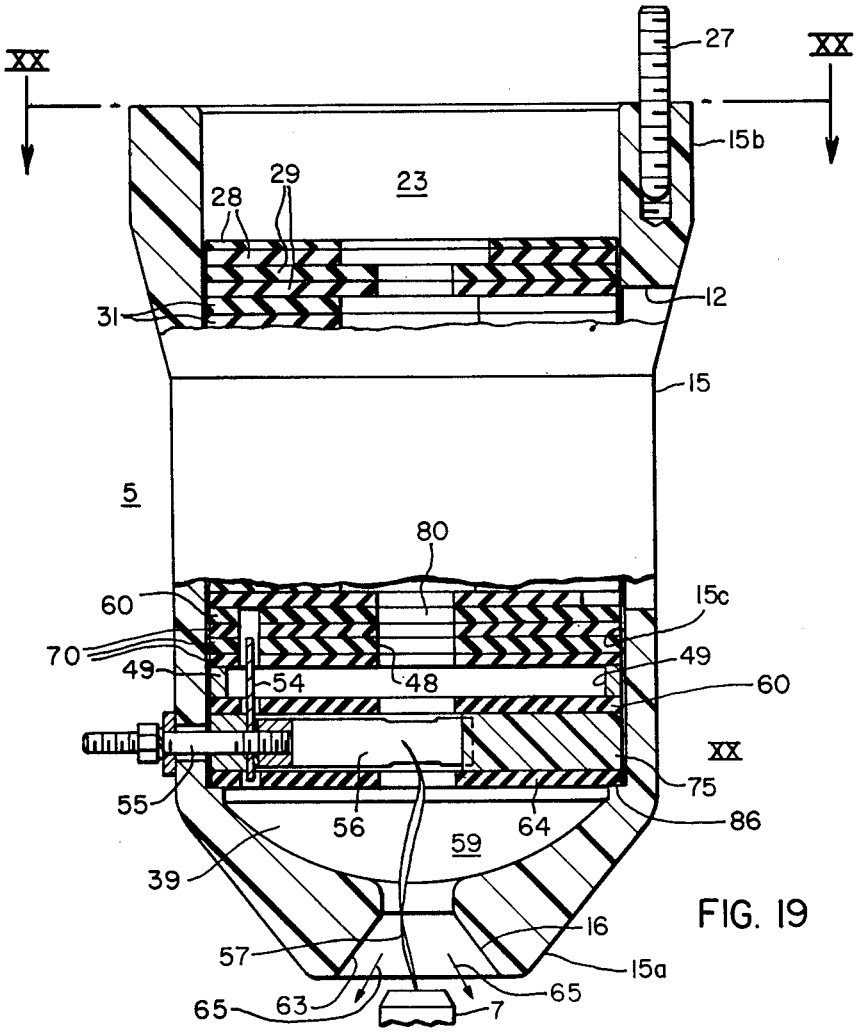
FIG. 19 is an enlarged side-elevational view, partially in vertical section, of the lefthand arc-extinguishing grid-unit of FIG. 1.

Below the relatively-stationary resistance contact 56 is another insulating orifice plate 64 of the type previously described, and more clearly illustrated in FIG. 12 of the drawings, and as illustrated in FIG. 19, there is finally disposed a somewhat open oil region, generally designated by the reference numeral 59, and reacting upon the established residual-current arc 57 to generate an explosive oil pressure, and cause an ejection out of the lower orifice opening 63, as indicated by the arrows 65 in FIG. 19.

Preferably, the several insulating plates, described above, are suitably cemented together to prevent lateral ejection of gas pressure, and also to maintain their mechanical integrity. Additionally, a plurality of insulating dowel pines 67 are provided, with accommodating holes being provided in the several plates, as designated by the reference numeral 66.

At the lower end of the outer shell member 15, there is finally provided an oil pocket 59 constituting a relatively-large-volume oil pocket-reservoir, which will, additionally, ensure the interruption of relatively low-amperage currents, which tend to assume a greater length than the relatively-high-amperage currents, which are interrupted in the upper end of the grid stack 5.

In this connection, it will be observed that the venting passages "A" and "B" provided at the upper end of the grid-stack 5 are of larger volume than the venting passages "C", "D", "E" and "F" disposed at the lower end of the grid stack 5, which are particularly effective in interrupting low-values of arcing currents, where the internal pressures are somewhat reduced within the grid stack. As mentioned, the high-amperage arcing currents are interrupted at the upper end of the grid stack 5, and for this reason, due to the higher internal pressures encountered, the venting passages "A" and "B" are somewhat larger in size. The lower four venting passages "C", "D", "E" and "F" are somewhat smaller in volume, and thereby tend to restrict the internal pressures within the grid-stack 5.

With reference to FIG. 5, it will be observed that the oil-pumping-cylinder assemblage 20 comprises an operating cylinder 46, within which is spring-biased a movable piston member 44 having a lower portion stem 53, which is picked up on the closing stroke by an abutmentstem 68 secured to the outer ends of an auxiliary crossarm, designated by the reference numeral 69, and also fixedly secured to the vertically-extending insulating operating rod 10.

Preferably, a one-way-acting valve 47 is provided at the lower end of the stationary piston chamber 77 to prevent a reverse flow of the movable piston member 44 upon high pressures being encountered within the grid-stack 5. Thus, it is only during relatively-low values of arcing pressure that the movable piston 53 is effective to move downwardly under the bias of the compression springs 78 to thereby force oil 39 into the upper oil reservoir area 23, and down through the two vertical oil passages 9, 17 provided along the inner side walls 15*a* of the outer insulating shell member 15. These two spaced oil passages 9, 17, of course, communicate with the three inlet sets of plates to provide an inward flow of oil into the arcing passage 80, where the established arc 41 is centrally drawn.

It will be noted that the upper end of the operating cylinder 46 for the oil-pumping assembly 20 is open, as provided by apertures 81, so that there is no restriction, or impediment to the downward movement of the piston 44. Also, upon upward recharging movement of the movable piston 44 during the closing stroke, a plurality of valves (not shown) are associated with the movable piston member 44 to cause its unimpeded upward charging motion during the closing operation of the circuit-interrupter 1.

During the opening operation, the insulating operating lift-rod 10 moves downwardly, carrying with it the lower conducting cross-bar 6 and also the auxiliary cross-bar 69, the latter permitting downward motion of the two spring-biased movable pistons 44, provided the internal pressure conditions are proper, that is sufficiently low, within the grid-units 5.

The downward movement of the movable rod-shaped contacts 7, 8 away from the stationary contacts 6 and 6A draw two arcs 41 internally within the grid structures 5. During low values of current, each arc 41 will be interrupted in the lower portion of the grid stack 5. There will, of course, be somewhat reduced internal pressures during such low-amperage arc interruption. On the other hand, during large values of current being interrupted, the internal pressures will be enhanced, that is increased, and the interruption will probably occur in the upper portion of the grid-stack 5 adjacent the larger-diameter venting exhausting passageways "A" and "B".

The resistance assemblage 64 will cause the main current arc 41 to be readily interrupted by the bypassing current flowing through the resistance assemblage 64 until the movable rod-shaped contacts 7, 8 separate from the lower-disposed metallic resistance contacts 56, at this time drawing a residual-current arc 57 within each grid-unit 5 adjacent the lower central opening 63 provided in the outer shell member 15. This residual-current arc 57 is relatively easy to interrupt because of its low-amperage value, say, typically, for example, 60 amperes.

The pressure conditions, if not excessive, will permit the one-way acting valve 47 to open, and to supply oil under pressure, induced by the spring-biased piston action, into the upper large oil reservoir 23, where the two oil passages 9, 17 communicate such pressure down along the grid-stack 5, and into the three inlet openings "R", "S" and "T", as shown in FIG. 8. The inward flow of oil will strike the arc 41, which is, of course, drawn centrally along the grid stack 5 within the apertures 35, 61 and 71 provided in the several orifice plates 34, 60 and 71.

The oil will be forced to flow intimately into engagement with the established arc 41 through the central openings of the splitter-plates, and longitudinally of the arc, to exhaust out through the several venting, or exhausting passages "A", "B", "C", "D", "E" and "F", as shown in FIG. 8. As mentioned, these exhausting passages are somewhat disposed in opposite angular directions, so as to have a resultant "jet" force action, and thereby tend to neutralize the magnetic forces "F" (FIG. 1) occurring by the current "I" passing through the two terminal-bushings 3, 4 and the interconnecting cross-bar 6, which constitutes a somewhat U-shaped path, and thereby tends to move the grid units 5 outwardly by magnetic-force action. Thus, the jet-pressure action tends to neutralize these magnetic forces "F", and thereby to relieve the lateral stress forces imposed upon the lower ends 3*a*, 4*a* of the terminal-bushings 3 and 4.

With reference to FIG. 5, it will be observed that the oil-pump piston assembly 20 provides an adequate flow of oil under pressure below the movable piston 44 into the upper chamber 23, wherein it communicates with the two vertical oil-inlet passages 9 and 17, shown more clearly in FIGS. 7 and 20 of the drawings.

During the interruption of high-amperage currents, the pump assembly 20 may be stalled, as illustrated in FIG. 6, and the arcing pressure, internally within the grid structure 5, will be adequate to provide the requisite amount of fluid-oil flow.

During the interruption of relatively high currents "I", such as, for example, 20,000 to 30,000 amperes in value, interruption is obtained in four cycles, or less, and the arc 41 is extinguished by the time the tip 7*a* of the movable contact 7 has reached the dotted lines 83 of FIG. 6.

For relatively low-current interruptions, say for example, 1,000 to 5,000, or 6,000 amperes, interruption occurs when the tip 7*a* of the movable contact 7 reaches the position designated by the dotted line 84 of FIG. 19.

The outer cylindrical shell 15 is formed, preferably of a filament-wound glass-epoxy material having the requisite mechanical strength, and providing a lower shelf portion, designated by the reference numeral 86, upon which the stacked plate elements 5 may rest upon and be compressed.

The exact manner of interruption of low-currents is not known with precision, but it is believed that during low-current interruption, pressure builds up within the upper oil-pocket chamber 23 with a little pressure being exhausted through the upper vent openings.

It will be observed that with the foregoing arrangement, that the arc-extinguishing grid structure 5 provides a semi-balanced exhaust-port design 12, 13, which directs the gas-thrusting forces in a direction with the proper magnitude, which substantially balances the magnetic forces (F) resulting from the current flow passing through the circuit-interrupter 1. Additionally, the oil-clearing notches 36 which are at the end of the exhaust ports 32 improves interrupting performance by reducing the oil-clearing time of the grid-unit 5. This allows the arc-splitter effect, resulting from the use of the splitter-plates 34, 60 and 70, to take place more rapidly from the point of time of arc initiation.

In the early portion of the opening stroke of the movable contact-rod 7, the arc 41 ionizes oil to a gas, which is expelled out of the larger top two ports "A" and "B". The exhaust ports "A" and "B" at the upper end of the grid structure 5 are, preferably, for the higher-current interruptions. The venting, or exhaust ports "C", "F", "E" and "F" disposed at the lower end of the stroke of the movable contact rod 7 are somewhat smaller in area, and are particularly adapted for lower-current interruptions. In other words, the higher-current interruptions occur at the upper end of the grid structure 5, and the lower-current interruptions require a somewhat greater length of arc 41, and thus are interrupted toward the lower end of the grid-stack 5.

There are, as shown in FIGS. 7 and 18, three interstitial oil pockets "L", "M" and "N", for example, which provide clean oil to the arcing region 80. In addition, the oil-pump flushing ports 9 and 17 are located on the inner side-walls 15*a* of the shell-like outer casing member 15. These communicate, as mentioned, directly with the upper-disposed pump assembly 20, and through the lateral inlet passages 42, 43, 51 and 52 to the arcing region 80. During an interrupting operation, the pump-assembly 20 forces oil through the inlet ports to impinge upon the established arc 41 to aid in the latters' extinction.

Figure 12:
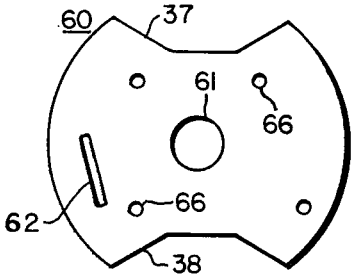

The improved grid structure 5, in addition, provides a keying slot 62, as illustrated more clearly in FIG. 12 of the drawings, which orients the exhaust ports, or venting ports 32 in the proper direction. This keying feature 62 (FIG. 12) makes mis-assembly virtually impossible.

As mentioned, the several insulating fiber plates are cemented together and pinned in a fixed position with fiber dowels 67. This insures that the arc gases are contained within the grid structure 5, and are exhausted only through the venting ports 32 to provide a proper interrupting effect.

Figure 21:
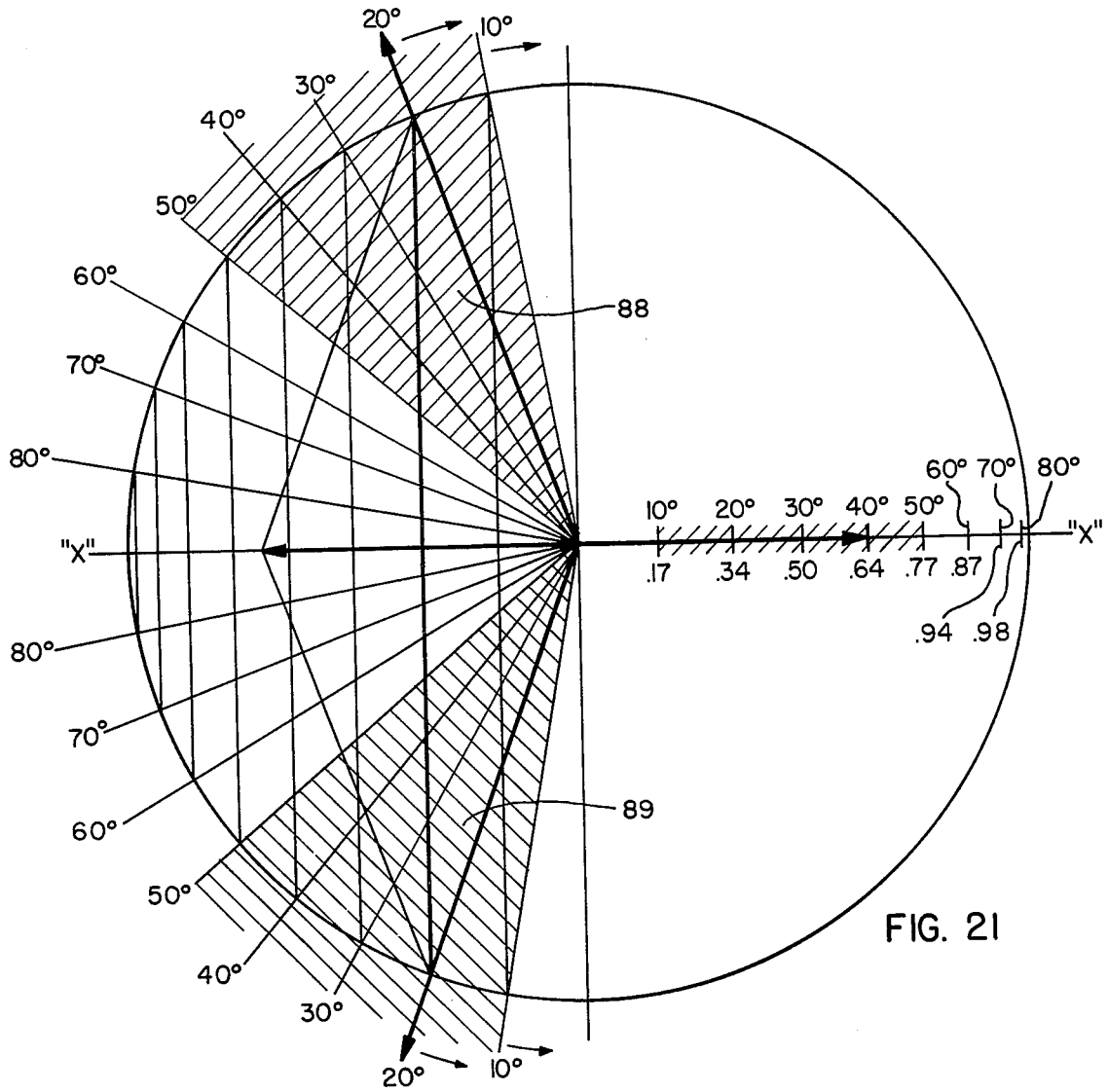

With reference to FIG. 21, it will be observed that the upper shaded portion 88 in the fourth quadrant with angular values from 10° to 50° are possible ranges of angular orientation for one of the venting ports 12, 13 of the arc-extinguishing grid unit 5. Corresponding with the angular shaded area 88 are corresponding lower-shaded angular measurements 89, representing possible degrees of divergence of the two venting ports 12, 13.

Naturally, the angular measurements will be, of course, symmetrical about the horizontal axis "X". The preferred range is, as mentioned, set forth in the shaded areas 88, 89, and extends between 80° angular divergence and 160° angular divergence of the ports 12, 13. A desired smaller angular range would be between 100° and 140°, as indicated by the cross-hatching 90, 91 in FIG. 21, with a preferred angular divergence displacement between the venting ports 12, 13 of substantially 120 angular degrees, as indicated by the arrows Z—Z in FIG. 21.

With further reference directed to FIG. 21, it will be noted that just above the horizontal axis "X" are the corresponding diverging angles between the venting ports 12, 13 on the upper side of the axis "X" with the corresponding resultant vector-per-unit just below the axis "X", as illustrated.

TYPICAL EXAMPLES OF APPLICATION

Figure 2:
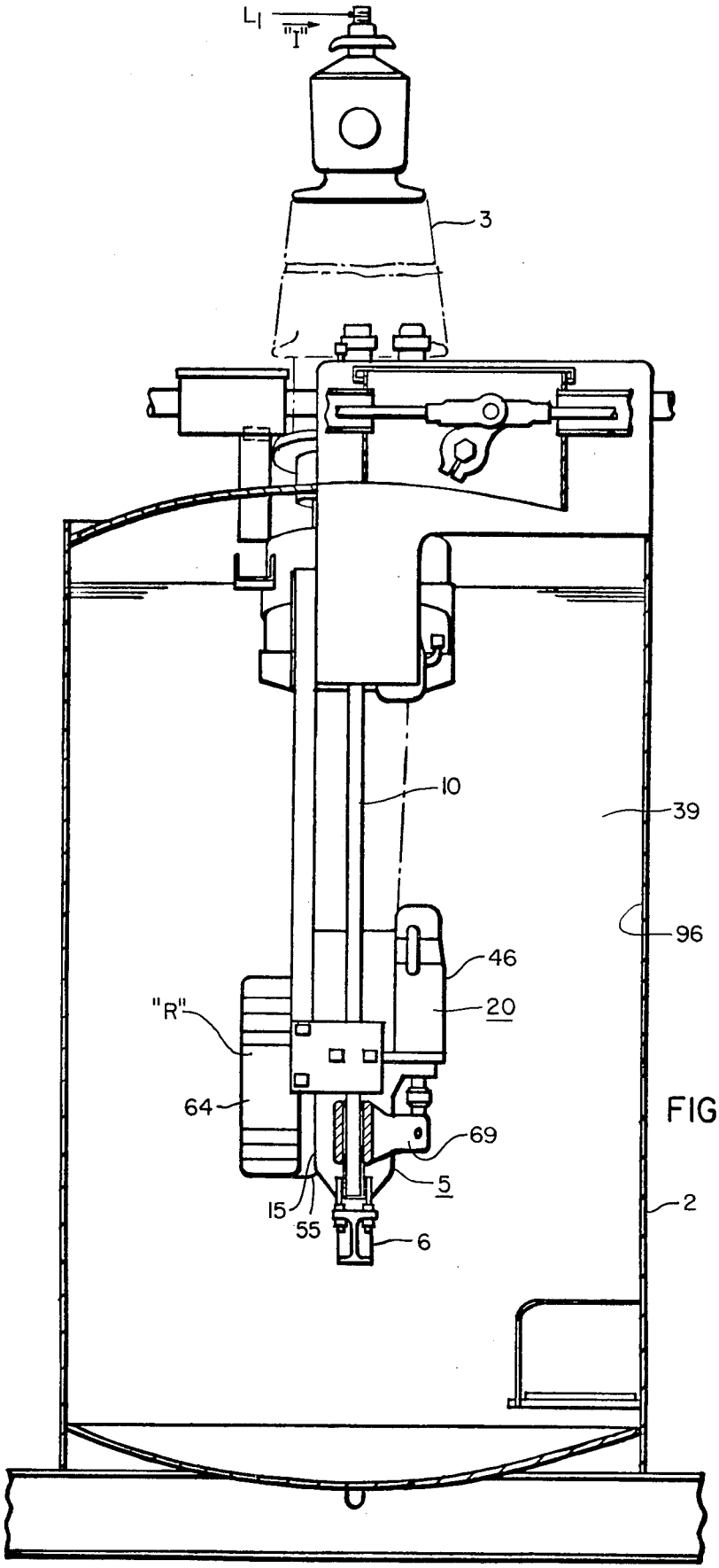
FIG. 2 is a vertical-sectional view taken along the line II—II of FIG. 1 looking in the direction of the arrows, again the separable contact structure being illustrated in the closed-circuit position.
Figure 3:
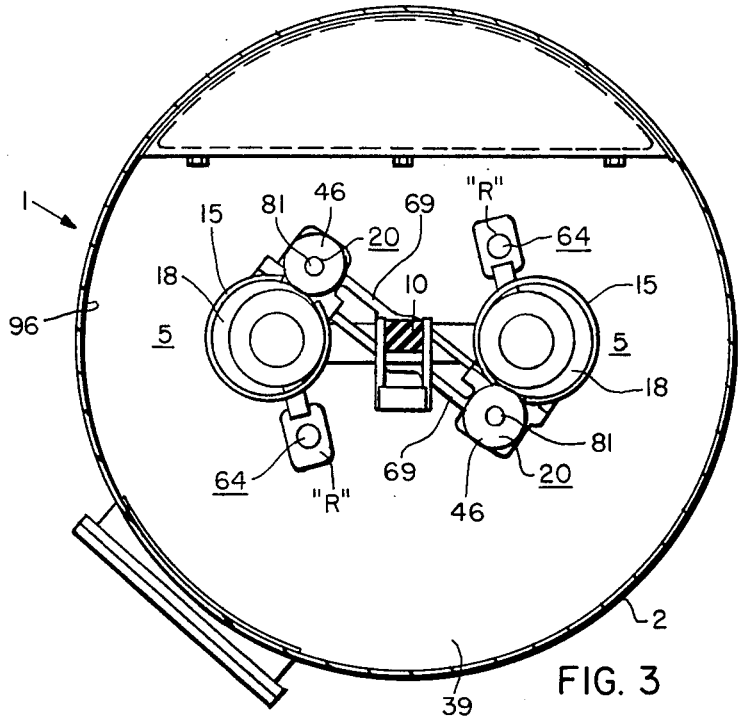
FIG. 3 is a plan view, in section, taken along the line III—III of FIG. 1 looking in the direction of the arrows.
Figure 4:
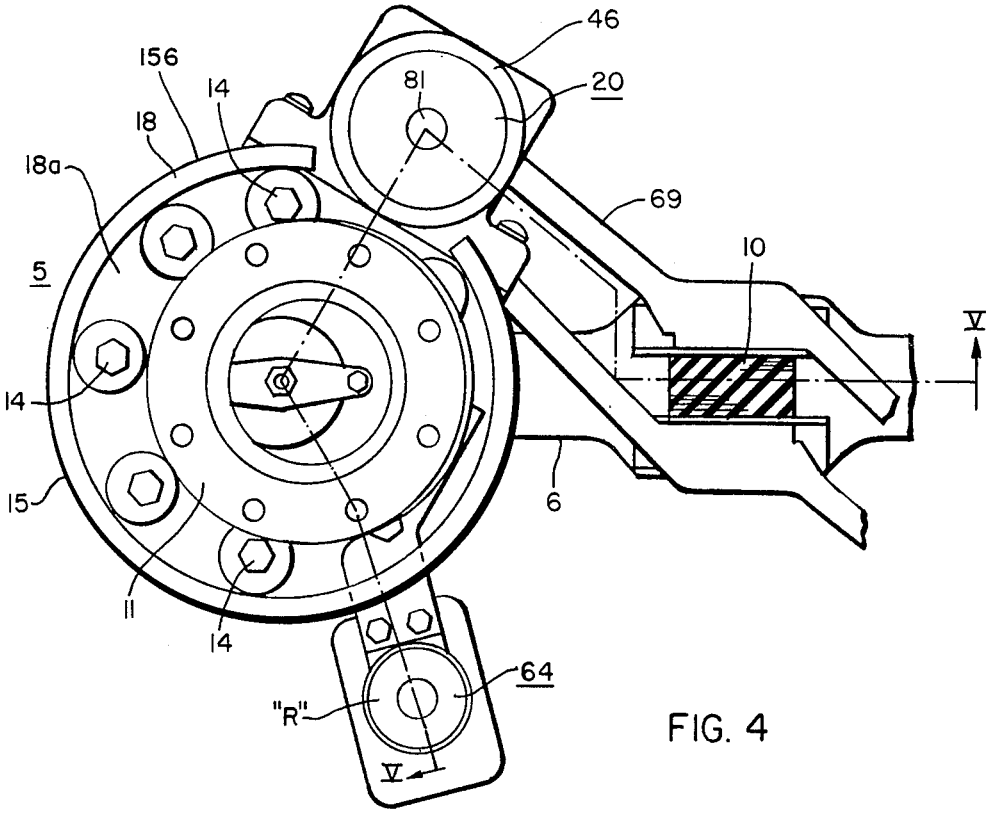
FIG. 4 is a plan view, in section, taken substantially along the line IV—IV of FIG. 1 looking in the direction of the arrows.
Figure 22:
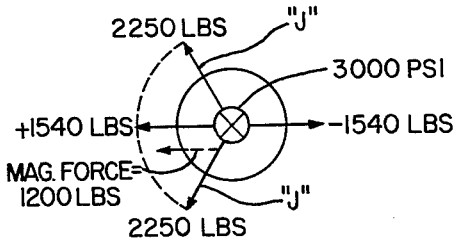

For a 63 KA oil-type circuit-interrupter 1 with the new type of construction, involving the semi-balanced type of vented interrupter, as shown in FIGS. 1–3, and designated herein as reference numeral 5, experiments show that the internal interrupting pressure is, for example, 3,000 lbs. per square inch. The thrusting jet force "J" (FIG. 22), exerted through each venting port 12, 13, is, for example, in such an instance, 2,250 lbs. The resultant jet-thrusting force, being a combined, cooperable force resulting from the aforesaid two jet-thrusting forces exerted through the two venting ports 12, 13 would be 1,540 lbs., as indicated in FIG. 22. Since the magnetic force for such a rating would be 1,200 lbs. maximum, the net force, exerted upon the lower ends of the terminal-bushings 3, 4, would be the difference between 1,540 lbs. less the magnetic force of 1,200 lbs. or a force difference of 340 lbs. being the lateral thrust exerted at the lower end of the terminal-bushings 3*a*, 4*a*.

EXAMPLE ILLUSTRATING A CROSS-BLAST DESIGN

With the interrupting internal pressure, as before, being 3,000 lbs. per square inch, and the venting ports 12, 13, instead of being at an angular divergence displacement, assuming now them to be on the same vertical axis "X" and constituting, in essence, one large vent of venting area equal to the combined venting area of the separate individual venting ports 12, 13, the thrusting jet forces "J", now as set forth above, would merely double, and would now add up to 4,500 lbs. (2,250 lbs. × 2).

Figure 23:
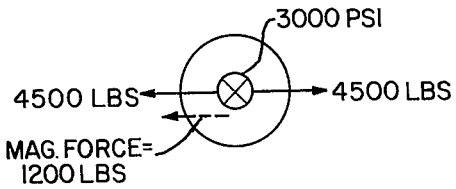

The resultant jet-thrusting force "J" for both venting ports, assuming that they were merged, would be 4,500 lbs. Assuming further, that the magnetic force again would be 1,200 lbs., exerted on the terminal-bushing, as indicated by the dotted arrow 93 in FIG. 23, the net force, for this particular example, using a cross-blast design, would be 3,300 lbs.

EXAMPLE USING A BALANCED INTERRUPTER DESIGN

Figure 24:
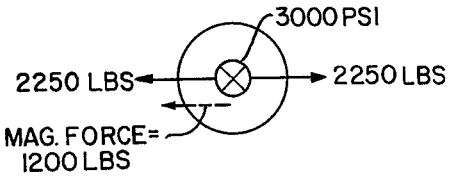

Assuming now that the venting ports 12, 13, instad of being at an angular divergence, were located and directed in opposite directions, on the opposite sides of the oil-grid unit 5, the condition would arise, as set forth in FIG. 24. Here again, assuming an internal interrupting pressure of 3,000 lbs. per square inch., again the jet-thrusting force "J" for each venting port 12, 13 would be 2,250 lbs. Since the jet-thrusting forces "J" directed through the two vents 12, 13 would now be neutralized, the resultant jet-thrusting force would be zero.

Again, the magnetic force "F" resulting from the line-current flow through the circuit-interrupter 1, would be, as before, 1,200 lbs. Thus, since the jet action would be neutralized by the opposition disposition, or location of the venting ports 12, 13, again the magnetic force "F" would not be affected by the oil-venting action, and would remain a net force "F" upon the lower ends of the terminal-bushings 3*a*, 4*a* of 1,200 lbs. in magnitude.

The semi-balanced grid design 5 neutralizes the magnetic forces "F" during interruption as long as the angle of blast is reasonably large-greater than 80° but less than 160°. The resultant thrust force would be .17 per unit to 0.77 per unit. If the angle is less than 80° the interrupter approaches a cross-blast design. This design imposes much higher thrust forces "J" than the magnetic forces "F" present. The net force would cause damage to interrupter components. If the divergence angle is greater than 160°, the magnetic forces "F" are larger than the resultant thrust force. This could also cause interrupter damage during high-current interruptions.

Since the arc exhaust gases are divided between the two vents 12, 13, and the angle of exhaust is greater than 80°, flashover to the tank wall 96 during interruption is minimized. If the vents 12, 13 were less than 80°, the concentration of gases would be more directly pointed to the tank wall 96 and flashover during interruption would be more likely. This approaches a cross-blast design, which would be the worst case.

The semi-balanced feature promotes the desirable placement, or location of the interrupter components, such as resistors and oil pumps to be positioned advantageously radially within the tank 2. The voltage clearance necessary between the interrupters 5, and from the interrupters 5 to the tank wall 96 can be drastically reduced by this expedient.

Although there has been illustrated and described a specific structure, it is to be clearly understood that the same was merely for the purpose of illustration, and that changes and modifications may readily be made therein by those skilled in the art, without departing from the spirit and scope of the invention.

What is claimed is:

1. A circuit-interrupter of the oil-break type including means defining an arc-extinguishing grid-unit, stationary contact means disposed adjacent the upper end of said grid-unit, a movable rod-shaped movable contact movable downwardly away from said relatively-stationary contact to establish an arc within the oil, a pair of laterally-spaced venting ports (12, 13) disposed in the side walls of the arc-extinguishing grid-unit only on one side of said grid-unit, and the angle of divergence between said two laterally-spaced venting ports having a divergence angle in the range from between 80° and 160°.

2. A circuit-interrupter of the oil-break type including means defining an arc-extinguishing grid-unit, stationary contact means disposed adjacent the upper end of said grid-unit, a movable rod-shaped movable contact movable downwardly away from said relatively-stationary contact to establish an arc within the oil, a pair of laterally-spaced venting ports (12, 13) disposed in the side walls of the arc-extinguishing grid-unit only on one side of said grid-unit, and the angle of divergence between said two laterally-spaced venting ports having a divergence angle in the range from between 100° and 140°.

3. A circuit-interrupter of the oil-break type including means defining an arc-extinguishing grid-unit, stationary contact means disposed adjacent the upper end of said grid unit, a movable rod-shaped movable contact movable downwardly away from said relatively-stationary contact to establish an arc within the oil, a pair of laterally-spaced venting ports (12, 13) disposed in the side walls of the arc-extinguishing grid-unit only on one side of said grid-unit, and the angle of divergence between said two venting ports (12, 13) being substantially 120°.

4. The combination in a tank-type oil circuit-interrupter of a grounded metallic tank filled with oil, a pair of terminal-bushings extending downwardly through the upper cover of said tank, each of said terminal-bushings having appended thereto at the lower ends thereof an arc-extinguishing grid-unit, a conducting cross-bar having a pair of rod-shaped movable contacts adjacent the outer ends of said cross-bar, stationary contact means disposed adjacent the upper end of each grid-unit interiorly thereof, each respective movable rod-shaped contact making separable contacting engagement with its respective relatively-stationary contact, means defining an arcing passage extending vertically, longitudinally, within each arc-extinguishing grid-unit, a pair of laterally-spaced venting ports (12, 13) for each of the two grid-units only on the outer side thereof away from the companion grid-unit, the two venting ports of each grid-unit being directed less than 180° in opposite outward directions away from the two venting ports on the other arc-extinguishing grid-unit, and the angle of divergence between the two venting ports on each arc-extinguishing grid being in the range between 80° and 160°.

5. The combination in a tank-type oil circuit-interrupter of a grounded metallic tank filled with oil, a pair of terminal-bushings extending downwardly through the upper cover of said tank, each of said terminal-bushings having appended thereto at the lower end thereof an arc-extinguishing grid-unit, a conducting cross-bar having a pair of rod-shaped movable contacts disposed adjacent the outer ends of said cross-bar, stationary contact means disposed adjacent the upper end of each grid-unit interiorly thereof, each respective movable rod-shaped contact making separable contacting engagement with its respective relatively-stationary contact, means defining an arcing passage extending vertically, longitudinally, within each arc-extinguishing grid-unit, a pair of laterally-spaced venting ports (12, 13) for each of the two grid-units only on the outer side thereof, the two venting ports of each grid-unit being directed less than 180° in opposite outward directions away from the two venting ports (12, 13) on the other arc-extinguishing grid-unit, and the angle of divergence between the two venting ports on each arc-extinguishing grid-unit being in the range between 100° and 140°.

6. The combination in a tank-type oil circuit-interrupter of a grounded metallic tank filled with oil, a pair of terminal-bushings extending downwardly through the upper cover of said oil tank, each of said terminal-bushings having appended thereto at the lower end thereof an arc-extinguishing grid-unit, a conducting cross-bar having a pair of rod-shaped movable contacts adjacent the outer ends of said cross-bar, stationary contact means disposed adjacent the upper end of each grid-unit interiorly thereof, each respective movable rod-shaped contact making separable contacting engagement with its respective relatively-stationary contact, means defining an arcing passage extending vertically, longitudinally, within each arc-extinguishing grid-unit, a pair of laterally-spaced venting ports (12, 13) for each of the two grid-units on the outer side thereof, the two venting ports of each grid-unit being directed less than 180° in opposite outward directions away from the two venting ports (12, 13) on the other arc-extinguishing grid-unit, and the angle of divergence between the two venting ports on each arc-extinguishing grid-unit being substantially 120°.

7. The combination according to claim 4, wherein a resistor assemblage and an oil-pumping assembly are disposed on the inward side of each arc-extinguishing grid-unit on opposite sides of the center-line with an angular measurement therebetween of less than 180°.

8. The combination according to claim 5, wherein a resistor assemblage and an oil-pumping assembly are disposed on the inward side of each arc-extinguishing grid-unit on opposite sides of the center-line with an angular measurement therebetween of less than 180°.

9. The combination according to claim 6, wherein a resistor assemblage and an oil-pumping assembly are disposed on the inward side of each arc-extinguishing grid-unit on opposite sides of the center-line with an angular measurement therebetween of less than 180°.

10. The combination in an oil-type circuit-interrupter of a grounded metallic oil tank, a pair of terminal-bushings extending downwardly interiorly into said oil tank from the upper end thereof and carrying a pair of laterally-spaced arc-extinguishing grid-units at the lower ends of said terminal-bushings, a conducting cross-bar for electrically interconnecting the two arc-extinguishing grid-units, a vertically-extending insulating lift-rod for causing the vertical actuation of said movable conducting cross-bar, the current "I" passing through the oil-type circuit-interrupter generating mechanical outward forces upon the terminal-bushings as a result of the magnetic field generated by the current "I" passing through the circuit-interrupter, each of the arc-extinguishing units having a pair of laterally-spaced venting ports (12, 13) only on the outer side thereof, and the resultant of the four jet forces as a result of the exhausting arcing gases passing outwardly through the four venting ports (12, 13) being substantially adequate, as measured by the jet-thrusting forces, to substantially counterbalance the resultant magnetic forces acting mechanically outwardly upon the lower ends of the two terminal-bushings.

11. The combination according to claim 10, wherein the divergence angle between the two venting ports on each arc-extinguishing grid-unit is in the range between 80° and 160° in angular magnitude.

12. The combination according to claim 10, wherein the divergence angle between the two venting ports on each arc-extinguishing grid-unit is in the range between 100° and 140° in angular magnitude.

13. The combination according to claim 10, wherein the divergence angle between the two venting ports (12, 13) on each arc-extinguishing grid-unit being substantially 120° in angular magnitude.

14. The combination according to claim 10, wherein a resistor assemblage and an oil-pumping device are disposed on the inward confronting sides of the two laterally-spaced arc-extinguishing grid-units, such two devices in each respective grid-unit being on the opposite side of the vertical plane, as determined by the said vertically-movable conducting cross-bar.

* * * * *